US010786002B2

(12) United States Patent
McKinney

(10) Patent No.: US 10,786,002 B2
(45) Date of Patent: Sep. 29, 2020

(54) PROTECTIVE CIGARETTE PACK CASE

(71) Applicant: Dossie McKinney, Vincent, AL (US)

(72) Inventor: Dossie McKinney, Vincent, AL (US)

( * ) Notice: Subject to any disclaimer, the term of this patent is extended or adjusted under 35 U.S.C. 154(b) by 0 days.

(21) Appl. No.: 15/599,033

(22) Filed: May 18, 2017

(65) Prior Publication Data

US 2019/0183173 A1 Jun. 20, 2019

Related U.S. Application Data

(60) Provisional application No. 62/338,482, filed on May 18, 2016.

(51) Int. Cl.

| | |
|---|---|
| ***A24F 15/12*** | (2006.01) |
| ***B65D 25/34*** | (2006.01) |
| ***B65D 6/02*** | (2006.01) |
| *B65D 77/04* | (2006.01) |

(52) U.S. Cl.

CPC ..... *A24F 15/12* (2013.01); *B65D 7/06* (2013.01); *B65D 25/34* (2013.01); *B65D 77/042* (2013.01); *B65D 2203/02* (2013.01)

(58) Field of Classification Search

CPC ..... A24F 15/12; B65D 7/06; B65D 25/34; B65D 2203/02

USPC ..... 206/259

See application file for complete search history.

(56) References Cited

U.S. PATENT DOCUMENTS 391,145 A * 10/1888 Hardin ..... B65D 5/6697 229/125.11
1,685,765 A * 9/1928 Mangan ..... B65D 85/10 206/259
1,860,637 A * 5/1932 Von Meister ..... A24F 15/12 206/239
2,315,900 A * 4/1943 Lupfer ..... A24F 15/12 206/259
3,140,777 A * 7/1964 Gordan ..... A45C 11/24 206/315.1
3,272,325 A * 9/1966 Schoenmakers ..... B65D 25/02 206/387.1
4,420,079 A * 12/1983 Gliniorz ..... G11B 23/02 206/408
4,759,443 A * 7/1988 Egly ..... G11B 33/0438 206/308.3
5,277,315 A * 1/1994 Plein ..... A24F 15/18 206/256
5,341,925 A * 8/1994 Fleenor ..... B65D 85/1045 206/268
5,732,820 A * 3/1998 Tsai ..... B65D 43/20 206/369
6,129,237 A * 10/2000 Miyahara ..... B65D 43/165 220/812

(Continued)

*Primary Examiner* — Ernesto A Grano

(57) ABSTRACT

A protective cigarette pack case having a top portion and a bottom portion whereby the bottom portion. The bottom portion can be a unitary piece or can be formed a front portion and back portion. The bottom portion is adapted to receive a cigarette hard pack bottom portion and the lid portion is adapted to be inserted onto a cigarette hard pack lid. The bottom portion has protruding ears. The lid portion further has a back panel whereby a bottom edge of the back panel has an inward bend that allows the lid portion to engage the paper on a lid of a cigarette hard pack such that it is held in tight communication. The lid portion utilizes the paper hinge of a hard cigarette pack thereby eliminating the need for any hinged apparatus in the protective cigarette pack case.

14 Claims, 5 Drawing Sheets

(56) References Cited

U.S. PATENT DOCUMENTS 6,669,023 B2 * 12/2003 Kikuchi ..... B42F 7/145 206/307
6,672,471 B2 * 1/2004 Cross ..... B65D 43/20 206/267
6,726,006 B1 * 4/2004 Funderburk ..... B65B 19/20 206/256
6,736,261 B1 * 5/2004 Thomas ..... B65D 5/5213 206/236
7,014,039 B2 * 3/2006 Henson ..... A24F 15/12 206/236
7,661,555 B1 * 2/2010 Evans ..... B65D 83/087 206/38
D668,142 S * 10/2012 Turner ..... D9/423
D668,145 S * 10/2012 Turner ..... D9/432
8,511,510 B2 * 8/2013 Pratte ..... A61L 2/26 16/359
8,540,113 B2 * 9/2013 Bailey ..... B65D 43/164 206/240
8,556,071 B2 * 10/2013 Holloway ..... B65D 85/1054 206/250
10,005,588 B2 * 6/2018 Kanbar ..... B65D 25/04
2004/0217116 A1 * 11/2004 Offerman ..... B65D 43/12 220/345.2
2005/0224374 A1 * 10/2005 Petrucci ..... B65D 5/4233 206/242
2007/0193895 A1 * 8/2007 Weiss ..... A24F 15/12 206/259
2009/0223841 A1 * 9/2009 Mack, Jr. ..... A24F 15/14 206/242
2010/0072206 A1 * 3/2010 Doyle ..... B65D 25/54 220/345.2
2010/0133140 A1 * 6/2010 Bailey ..... B65D 7/10 206/538
2011/0000931 A1 * 1/2011 Gelardi ..... B65D 50/046 221/1

* cited by examiner

PROTECTIVE CIGARETTE PACK CASE

CROSS-REFERENCE TO RELATED APPLICATION

This application claims the benefit of priority of U.S. Provisional Application No. 62/338,482 filed May 18, 2016 and fully incorporated by reference herein.

FEDERALLY SPONSORED RESEARCH

None

SEQUENCE LISTING

NONE

FIELD OF THE INVENTION

The invention relates to cigarette containers and more specifically a container that will protect a hard pack of cigarettes and still function just like a cigarette hard pack.

BACKGROUND OF THE INVENTION

Cigarettes are sold in paper packages from the manufacturer. These cigarette packages are problematic because they do not adequately protect the cigarettes from deformation or breakage during transport. The prior art has attempted in numerous ways to solve the problem of protecting cigarette packs using various types of receptacles and cases. Many of these prior art cases have movable and therefore breakable parts such as hinges. Also, other cigarette cases require a user to unload the cigarettes from their paper packaging into the case which can lead to cigarette damage or breakage. What is needed in the art is a cigarette case that is virtually indestructible and that incorporates and uses the paper hinge located on a cigarette hard paper pack as the hinge device instead of incorporating a hinge or other type of moveable and therefore breakable device on the cigarette pack.

SUMMARY OF THE INVENTION

The present invention is a cigarette pack case for use with paper cigarette hard packs. It is made of metal and is comprised of a bottom portion and a lid portion. Alternatively, it can be comprised of a back portion and a front portion that mate together to form the bottom portion and a lid portion that can easily be assembled to form a protective case around the pack. The lid portion is shaped to conform to the lid of a hard paper pack cigarettes and has a back panel that has an inward bend such that the bottom edge of the back panel is projected toward the front panel such that it allows the bottom edge of the back panel that allows for firm contact and grip with the lid portion of the cigarette pack such that the inward bend causes the bottom edge to indent into the paper pack and maintain a fixed position fully enveloping the lid portion. The bottom portion of the cigarette case has parallel ears protruding out of its top side edge that stabilize the lid portion on the bottom portion and provide rigidity for the case as a whole.

DRAWINGS

DETAILED DESCRIPTION

Figure 1:
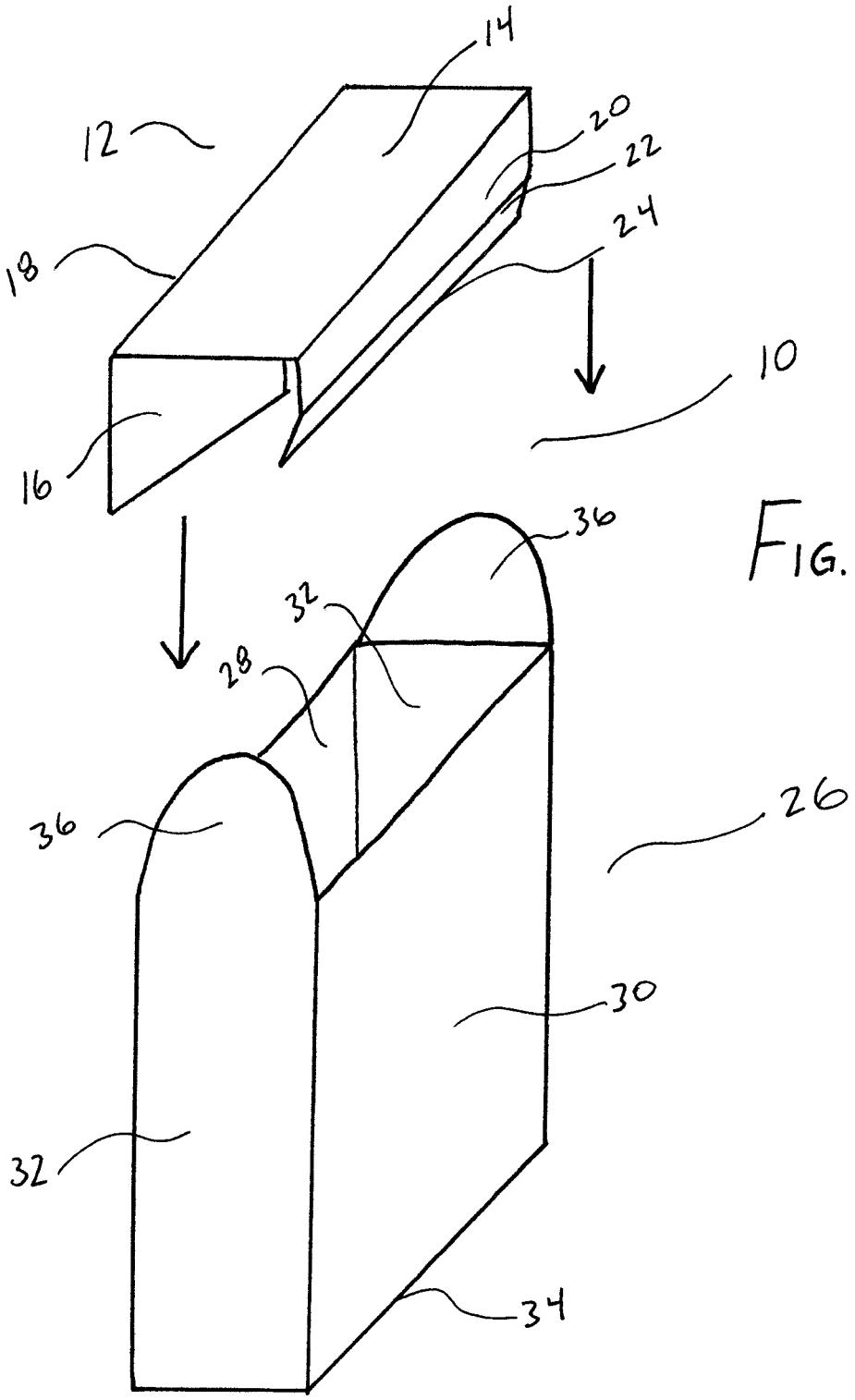
FIG. 1 is a back perspective view of a cigarette case.

The invention is generally depicted in FIGS. 1-7, but may be embodied in various other forms. The principles and teachings of the invention, therefore, can be applied to numerous alternative variations. Referring now to the drawings, FIG. 1 depicts a hard pack cigarette pack case 10 with a lid portion 12 and a bottom portion 26. The lid portion 12 has a top panel 14, two side panels 16, a front panel 18 and a back panel 20. The back panel 20 has an inward bend 22 such that it causes the back panel 20 bottom edge 24 to project forward toward the front panel 18. The dimensions of the lid portion 12 are such that the lid portion 12 nests onto the top of a cigarette hard pack such that there is a tight frictional connection. This is further achieved by use of an inward bend 22 of the back panel 20 that causes the bottom edge 24 to projects forward to indent into the paper pack and maintain a fixed position fully enveloping the lid portion 12. The lid portion is ideally made of a metal such as steel, copper, silver, tin, aluminum along with other malleable metals. The lid portion 12 in a preferred embodiment would be formed out of a flat sheet of metal and dimensioned appropriately by metal stamping the flat sheet or by cutting the flat sheet with either shears or by cutting torch or other similar means. The lid portion 12 could also be molded and cast using molten metal.

The bottom portion 26 of the cigarette pack case 10 as shown in FIG. 1 has a front panel 28, back panel 30, side panels 32, a bottom panel 34 and protruding ears 36 located in the top of the side panels 32. The bottom portion 26 can be formed of metal such as steel, copper, silver, tin, aluminum along with other malleable metals and could be formed of sheets of metal stamped or cut into appropriate configurations to result in, after welding or soldering, the bottom portion 26 of the cigarette pack case 10. The bottom portion 26 and the lid portion 12 can be customized or personalized by engraving or etching desirable indicia, words, symbols, logo, picture or other such design for purposes of ornamentation and identification of the cigarette pack case 10.

Figure 2:
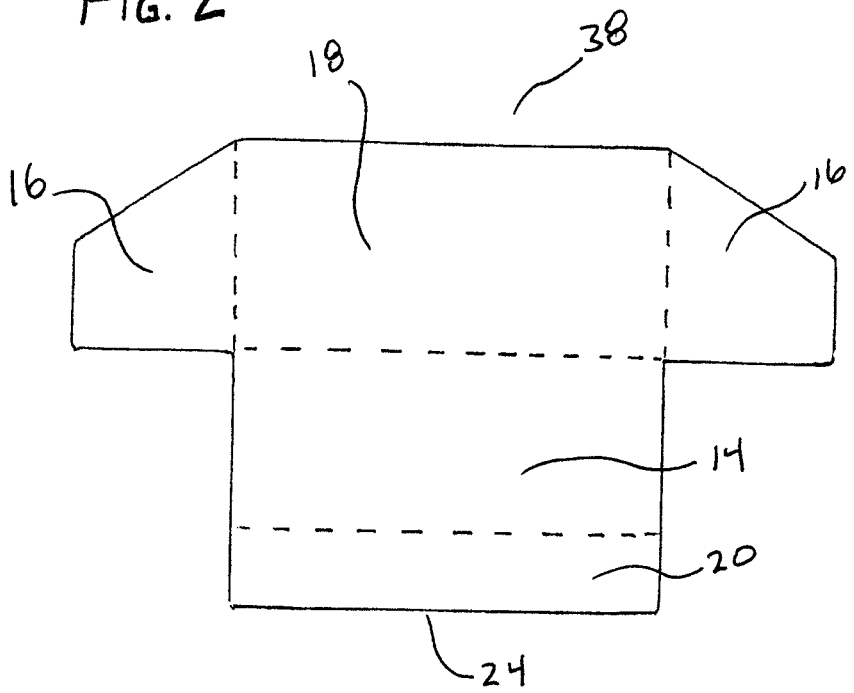
FIG. 2 is a top plan view of a an unformed lid portion of a cigarette case.

Referring now to FIG. 2, there is shown an unformed lid portion 38 having a top panel 14, two side panels 16, a front panel 18, and a back panel 20. These panels are defined by their perimeter and the shown hashed lines in FIG. 2. These panels are bent in the appropriate manner along the hashed lines shown in FIG. 2 to achieve a formed lid portion 12 as shown in FIG. 1.

Figure 3:
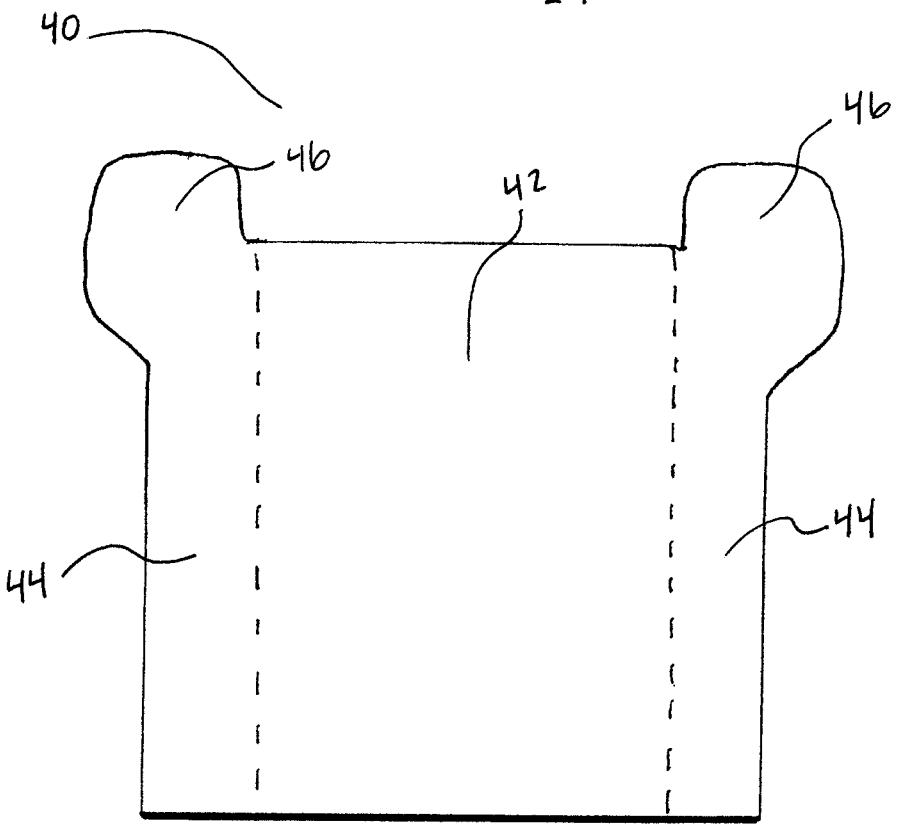
FIG. 3 is a top plan view of an unformed back portion of a cigarette case
Figure 4:
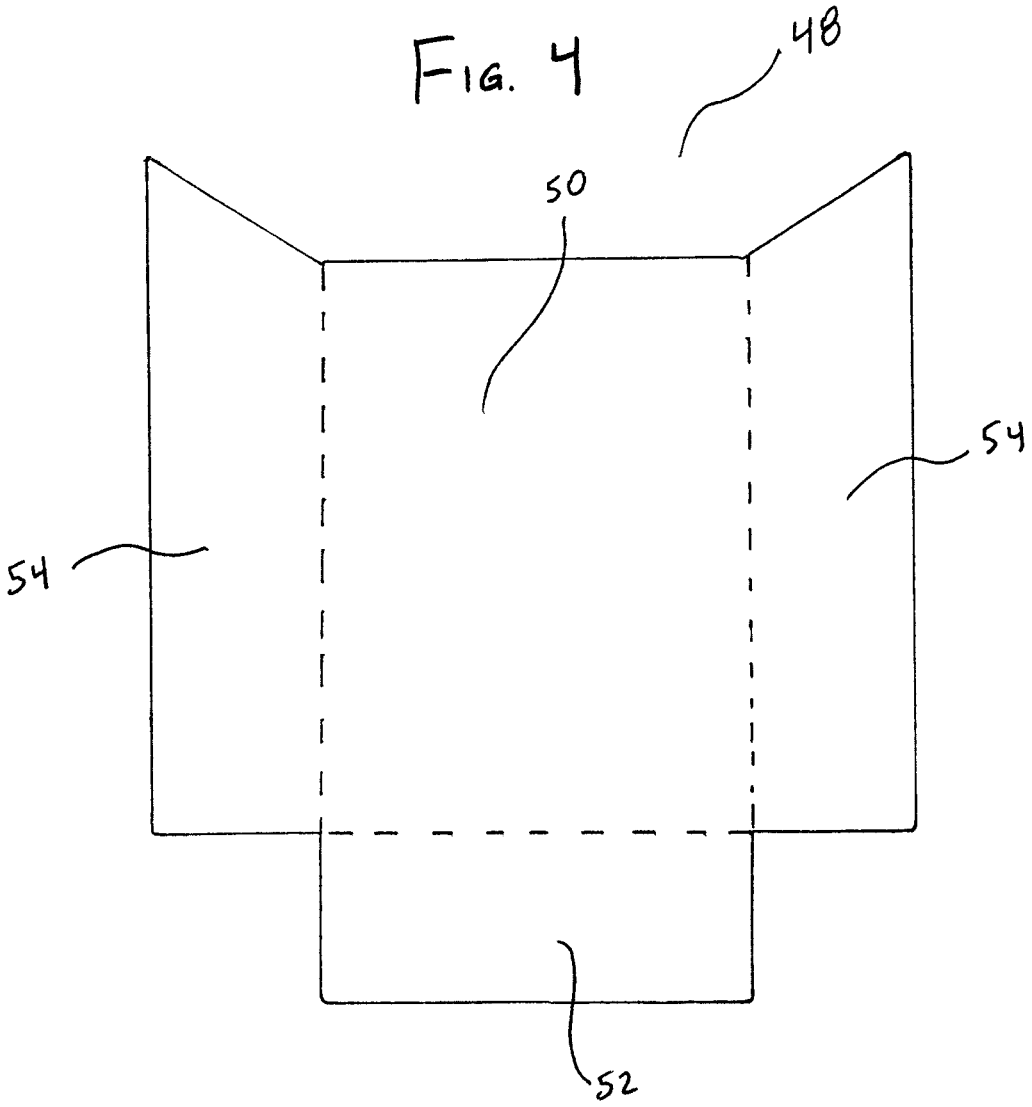
FIG. 4 is a top plan view of an unformed front portion of a cigarette case.

Referring now to FIG. 3, there is shown an unformed back portion 40 of the bottom portion 26 of a cigarette of a cigarette pack case 10. FIG. 4 shows an unformed front portion 48 of the bottom portion 26 of a cigarette pack case 10. In one embodiment, the back portion 40 and the front portion 48 are designed such that the back portion 40 is insertable into the front portion 48 such that they form the bottom portion 26 of the cigarette pack case 10 after the appropriate bending and formation of the front 48 and the back portion 40. This configuration allows for the bottom portion 26 to be formed without having to stamp or cut and join by means of soldering and welding the various panels 28, 30, 32, 34, and 36 as shown in FIG. 1. It allows a user to disengage the front portion 48 from the back portion 40 by pulling them apart. The dimensions of the front portion 48 and the back portion 40 are such that they fit together in tight frictional communication using the bending attributes characteristic in metal and capable of protecting a hard cigarette pack. The unformed back portion 40 has a back panel 42, side panels 44 and protruding ears 46 which are located at the top edge of said side panels 44. The unformed front portion 48 has a front panel 50, a bottom panel 52 and side panels 54.

Figure 5:
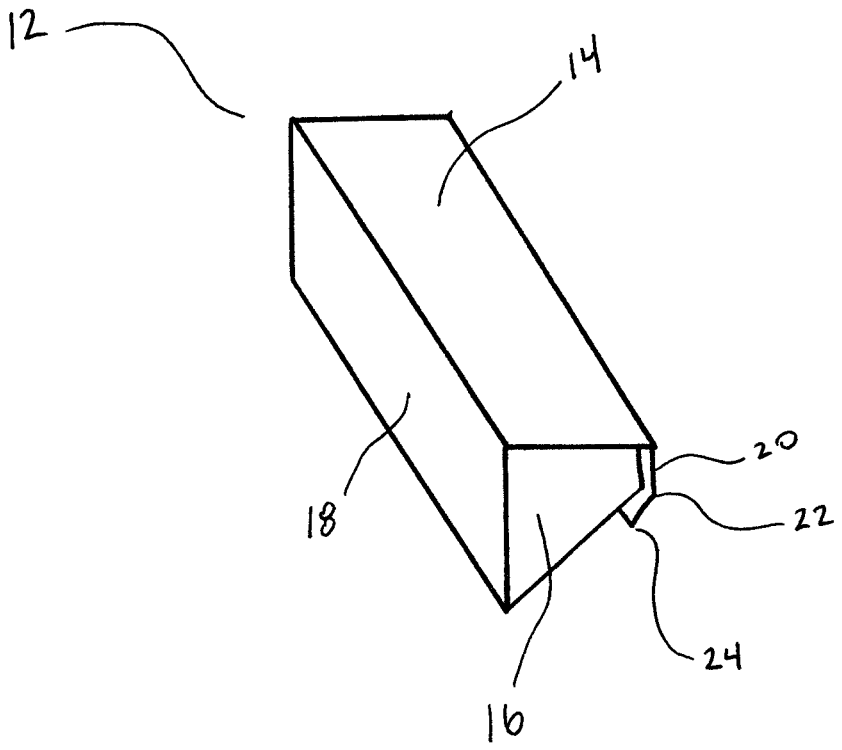
FIG. 5 is a side perspective view of a formed lid portion of a cigarette case.

Referring now to FIG. 5, there is shown a side perspective view of the formed lid portion 56 having a top panel 14, a front panel 18, side panels 16 a back panel 20 and an inward bend 22 of the back panel 20 such that the bottom edge 24 of the back panel 20 projects forward. The inner compartment formed by the lid portion 56 is adapted to receive the lid of a cigarette hard pack in frictional communication such that it firmly grasps the cigarette hard pack lid and the inward bend 22 further enhances this grasping effect by projecting the bottom edge 24 of the back panel 20 into the paper lid such that it indents and anchors the formed lid portion 56 to the cigarette hard pack lid.

Figure 7:
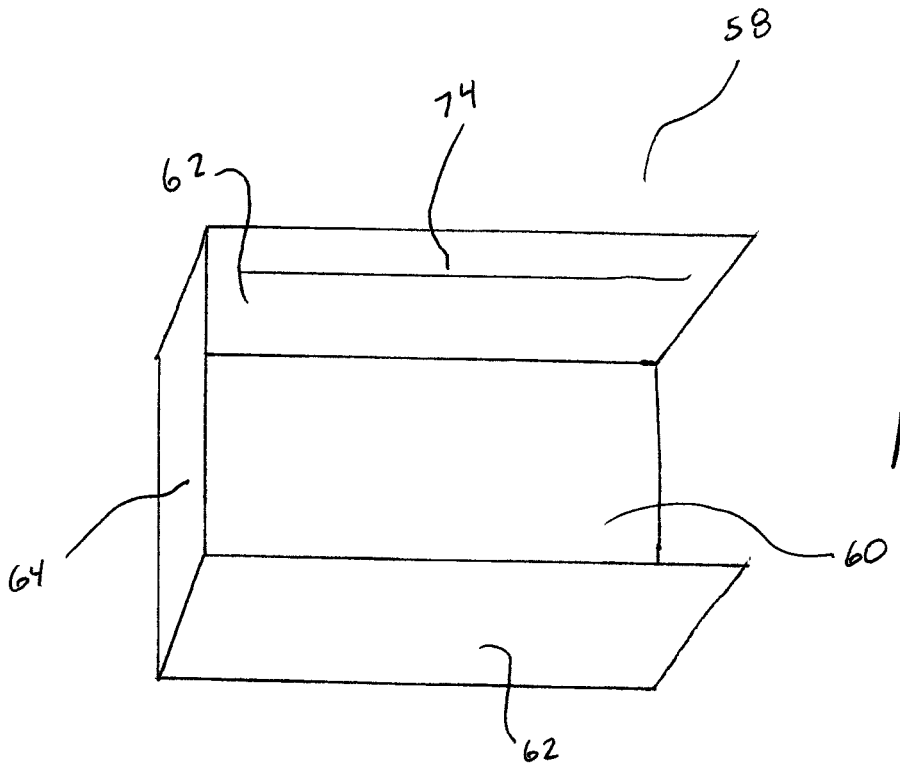
FIG. 7 is a side perspective view of a formed back portion of a cigarette case bottom portion.
Figure 6:
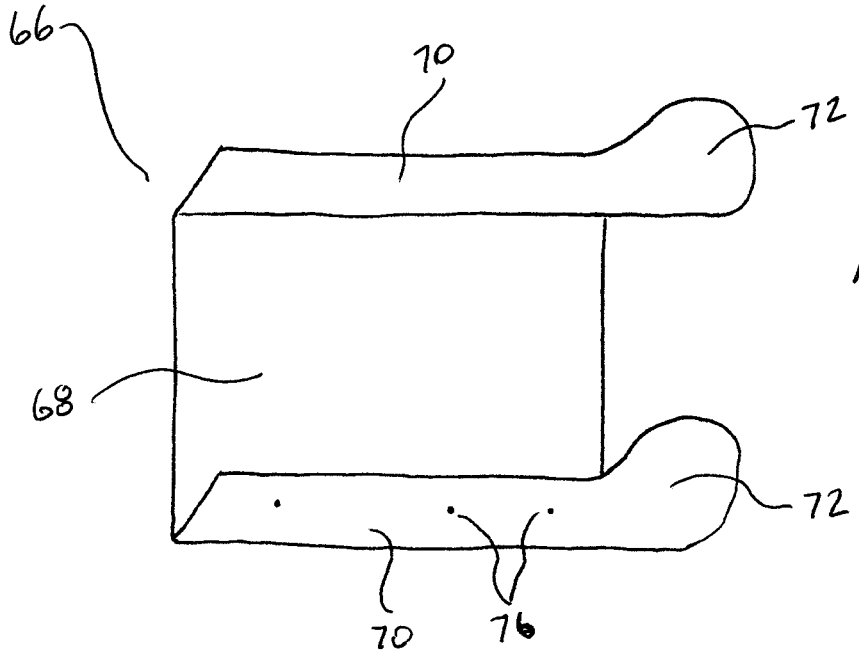
FIG. 6 is a side perspective view of a formed front portion of a cigarette case bottom portion.

Referring now to FIG. 6 and FIG. 7 Both the back portion 40 and the front portion 48 are bent along hashed lines as shown in FIG. 3 and FIG. 4 such that they produce the formed front portion 58 as shown in FIG. 7 and the formed back portion 66 as shown in FIG. 6. The formed front portion 58 has a front panel 60, side panels 62 and a bottom panel 64. The formed back portion 66 has a back panel 68, side panels 70 and protruding ears 72 located on the top of the side panels 70. The protruding ears 72 allow for the lid portion 12 to rest on top of the bottom portion 26 such that the cigarette pack case 10 is rigid and does not move from side to side and does not injure the pack of cigarettes should external force be applied. The formed front portion 58 receives the formed back portion 66 such that they form the bottom portion 26 which acts as a compartment for the cigarette pack. The formed front portion 58 and formed back portion 66 are dimensioned such that they provide a tight fitting compartment for a cigarette hard pack.

To further promote adequate nesting between the formed front portion 58 and formed back portion 66, there is located in the side panels 60 of the formed front portion 58 a longitudinal channel 74. The formed back portion 66 has divots 76 formed along its side panels 70 that align with said longitudinal channel 74 of the formed front portion 58 such that it aids in maintaining rigid connection of the formed front portion 58 with said formed back portion 66 by way of the divots 76 maintaining a fixed presence within said longitudinal channels 74. The formed front portion 58 and back portion 66 are formed of various malleable metals.

The principles, embodiments and modes of operation of the present invention have been set forth in the foregoing specification. The embodiments disclosed herein should be interpreted as illustrating the present invention and not as restricting it. The foregoing disclosure is not intended to limit the range of equivalent structure available to a person of ordinary skill in the art in any way, but rather to expand the range of equivalent structures in ways not previously contemplated. Numerous variations and changes can be made to the foregoing illustrative embodiments without departing from the scope and spirit of the present invention.

What I claim is:

1. A protective cigarette pack case, comprising: a lid portion and a bottom portion wherein the lid portion has an inward bend on a back panel bottom edge and whereby said inward bend of said lid portion of said protective cigarette pack case engages a lid of a paper cigarette hard pack by pressing and indenting into a back of said lid of said paper cigarette hard pack when said paper cigarette hard park lid is inserted into said lid portion; said bottom portion of said protective cigarette pack case comprises a front portion and a back portion; wherein said front portion has two side panels, wherein there are formed a longitudinal channel on the interior surface of said two side panels; and wherein said bottom portion of said protective cigarette pack case receives a bottom portion of said paper cigarette hard pack whereby said lid portion works in conjunction with said bottom portion by using a paper hinge located on said paper cigarette hard pack.

2. The protective cigarette pack case of claim 1 wherein the bottom portion of the protective cigarette pack case is a unitary piece conformed to the shape of the bottom portion of a said paper cigarette hard pack.

3. The protective cigarette pack case of claim 2 wherein the bottom portion of said protective cigarette pack case has protruding ears on the top of side panels of said protective cigarette pack case bottom portion.

4. The protective cigarette pack case of claim 1 wherein the back portion has two side panels with protruding ears on the top of said side panels and whereon said said panels there are formed divots on the exterior surface of said side panels such that they conform to said longitudinal channels of front portion side panels such that the divots nest with the longitudinal channels and a hollow space is created between said front portion and back portion to receive said paper cigarette hard pack.

5. The protective cigarette pack case of claim 4 wherein the front portion has personalized etchings on its front panel.

6. The protective cigarette pack case of claim 4 wherein the lid portion; and said front portion and said back portion that form said bottom portion are made of metal.

7. The protective cigarette pack case of claim 6 wherein said metal material is at least one of steel, aluminum, silver, brass, gold, and titanium.

8. The protective cigarette pack case of claim 1 wherein the front portion has personalized etchings on its front panel.

9. The protective cigarette pack case of claim 1 wherein the lid portion and said bottom portion are made of metal.

10. The protective cigarette pack case of claim 9 wherein said metal material is at least one of steel, aluminum, silver, brass, gold, and titanium.

11. A method of making a protective cigarette pack case, comprising the steps of:

providing three metal plates;

forming said three metal plates into a lid portion, a front portion and a back portion whereby said front portion and back portion join together to create a bottom portion having a hollow space such that when lid portion and bottom portion are installed on a cigarette hard pack they are in tight communication with said cigarette hard pack and allow use of a cigarette paper hard pack's hinge to open and shut the protective cigarette case;

bending the lid portion to form a top panel, two side panels, a front panel, and a back panel and an inward bend on the bottom edge of the back panel such that the inward bend on the bottom edge of the back panel will frictionally attach to a lid of a paper cigarette hard pack by pressing and indenting the inward bend on the bottom edge of the lid portion into the back of the lid of the paper cigarette hard pack when the paper cigarette hard park lid is inserted into the lid portion;

bending the front portion such that there is a resulting front panel, two side panels and a bottom panel; and bending the back portion such that there is a resulting two side panels and a back panel.

12. The method of claim 11 further comprising the step of forming longitudinal channels on the interior surface of the front portion side panels and forming divots on the exterior surface of the side panels of the back portion such that divots nest in the longitudinal channels when the front portion and back portion are joined.

13. The method of claim 11 wherein the front portion has personalized etchings on its front panel.

14. The protective cigarette pack case of claim 11 wherein the protective cigarette pack case is made of at least one of metal material comprising steel, aluminum, silver, brass, gold, and titanium.

* * * * *